United States Patent [19]

Boemer

[11] 4,149,347

[45] Apr. 17, 1979

[54] LOWERABLE MAST

[75] Inventor: Curt C. Boemer, Pretoria, South Africa

[73] Assignee: Sectional Poles Africa (Proprietary) Limited, South Africa

[21] Appl. No.: 875,812

[22] Filed: Feb. 7, 1978

[30] Foreign Application Priority Data

Feb. 28, 1977 [ZA] South Africa ..... 77/1184

[51] Int. Cl.[2] ..... F04H 12/34

[52] U.S. Cl. ..... 52/116; 52/32

[58] Field of Search ..... 52/117, 721, 645, 28, 52/29, 40, 116, 32

[56] References Cited

U.S. PATENT DOCUMENTS 3,355,847 12/1967 Pratt ..... 52/116

FOREIGN PATENT DOCUMENTS 2339851 11/1974 Fed. Rep. of Germany ..... 52/116

1204939 1/1960 France ..... 52/116

911784 11/1962 United Kingdom.

968113 8/1964 United Kingdom.

1084779 9/1967 United Kingdom.

1289074 9/1972 United Kingdom.

1460025 12/1976 United Kingdom.

*Primary Examiner*—Price C. Faw, Jr.

*Assistant Examiner*—Carl D. Friedman

[57] ABSTRACT

A lowerable mast comprising first and second sections, the first section being anchorable at one end in an anchoring position, the second section being pivotally connected intermediate its ends to the first section by a pivotal interconnection with portion of its one end in overlapping relationship with at least portion of the first section in any of its pivotal positions, opposed inwardly directed faces of the overlapping regions of the first and second sections providing sliding co-operative faces for supporting the second section relative to the first section.

9 Claims, 8 Drawing Figures

LOWERABLE MAST

BACKGROUND OF THE INVENTION

This invention relates to a lowerable mast.

According to the invention there is provided a lowerable mast comprising first and second sections, the first section being anchorable at one end in an anchoring position, the second section being pivotally connected intermediate its ends to the first section by a pivotal interconnection with portion of its one end in overlapping relationship with at least portion of the first section in any of its pivotal positions, opposed inwardly directed faces of the overlapping regions of the first and second sections providing sliding cooperative faces for supporting the second section relative to the first section.

The overlapping regions of the first and second sections may each be semi-cylindrical. In a preferred form, the overlapping regions are each of semi-octagonal cross sectional profile. Other cross sectional profiles are possible, e.g., semi-hexagonal. The portions of the first and second sections which do not overlap may be of corresponding profile, i.e., in the preferred embodiment, octagonal.

The cross sectional dimensions of the mast may decrease in a direction away from the anchoring position.

When the mast is used as a light mast, attachment means may be provided at the other end of the second section for attaching a light thereto. The second section may then be hollow and may contain electrical wiring interconnecting the light and a disconnectable terminal provided at or near said one end of the second section. The disconnectable terminal may include a plug adapted to fit matingly in a socket provided in the first section at or near its lower end.

The first section may have a slanting face at its end remote from the anchoring position, and the second section may have a mating slanting face adapted to co-operate with the slanting face on the first section to permit lowering of the second section in one direction only. If desired, further slanting faces may be provided at the junction of said one end of the second section and on the first section near its anchoring position.

A guide formation may be provided on one of the first and second sections for guiding the sections during pivotal movement proximate to the operative position of the mast.

The first and second sections may have frictional engagement members at opposed faces at suitable positions adapted to frictionally retain the mast in its operative position.

The pivotal interconnection may include a bush extending transversely from an inner wall of one of the first and second sections and rotatably received in a cylindrical socket extending outwardly from an opposed inner wall of the other of the first and second sections, the first and second sections being held together by a pin extending co-axially through the socket and bush. The pin may be in the form of a bolt or stud with a nut at one end.

The invention is now described by way of example with reference to the accompanying drawings, in which.

Figure 3:
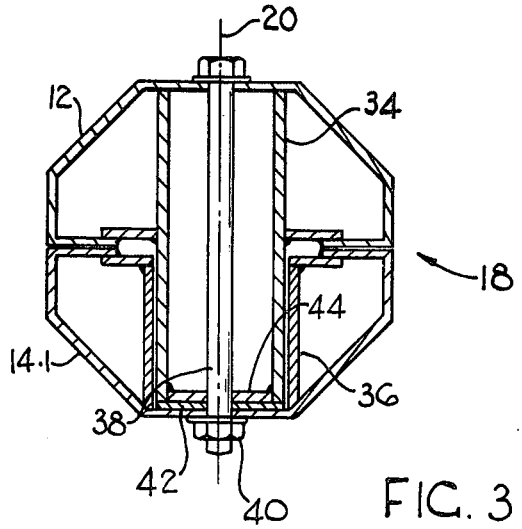
FIG. 3 shows a section to a larger scale along line III—III of FIG. 1.

Referring to the drawings, reference numeral 10 generally indicates a lowerable mast which comprises a first section 12 and a second section 14. The first section 12 is anchored at one end, e.g. in the ground, by means of a flange 16. The second section 14 is pivotally connected intermediate its ends by a pivotal interconnection generally indicated at 18 about a pivot axis 20.

The second section thus has a lower portion 14.1, portion of which is always in overlapping relationship with at least portion of the first section 12 and which is of mating semi-octagonal cross sectional profile. The first section 12 is also of such mating semi-octagonal profile over a major portion of its length. The remainder of the first section 12 is of octagonal cross sectional profile while the upper portion 14.2 of the second section is similarly of octagonal cross sectional profile over a major portion of its length. As will be appreciated, when the lower portion 14.1 is in its position as shown in FIG. 1, it together with the first section 12 forms a mast of octagonal outer profile.

Figure 5:
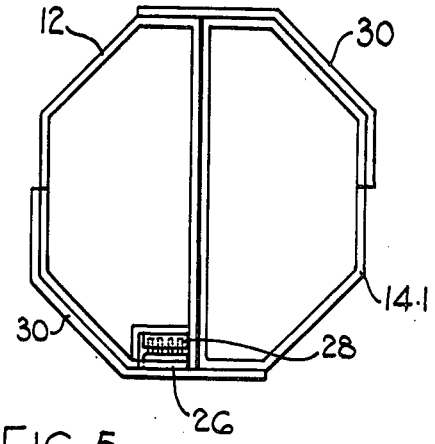
FIG. 5 shows a section along line V—V of FIG. 4.
Figure 6:
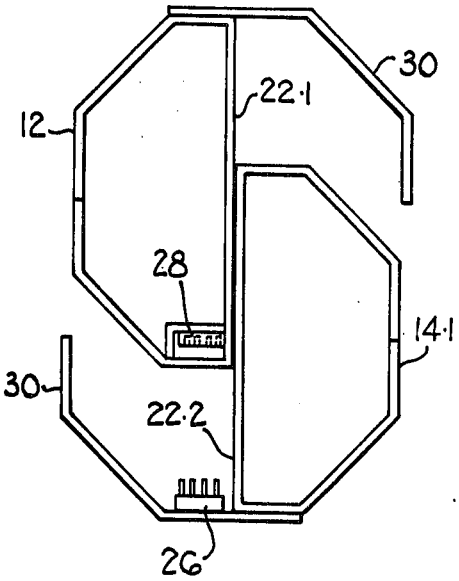
FIG. 6 shows a section as in FIG. 5, but with the second member slightly pivoted relative to the first member.

As shown more clearly in FIGS. 5 and 6, in the overlapping regions of the first and second sections, opposed inwardly directed faces 22.1 and 22.2 are provided. The faces 22.1 and 22.2 co-operate slidingly and assist in supporting the second section relative to the first section during all pivotal positions. Although such assistance decreases as the second section is pivoted, there is more than adequate support when the mast is in its operative position.

Figure 1:
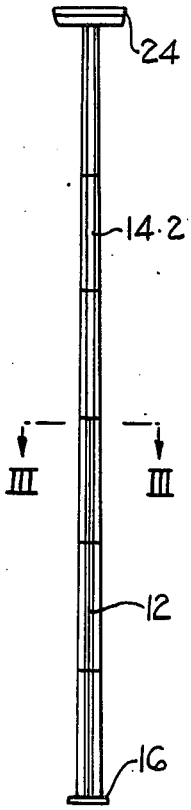
FIG. 1 shows a side elevation of a lowerable mast according to the invention in its erect operative condition.
Figure 2:
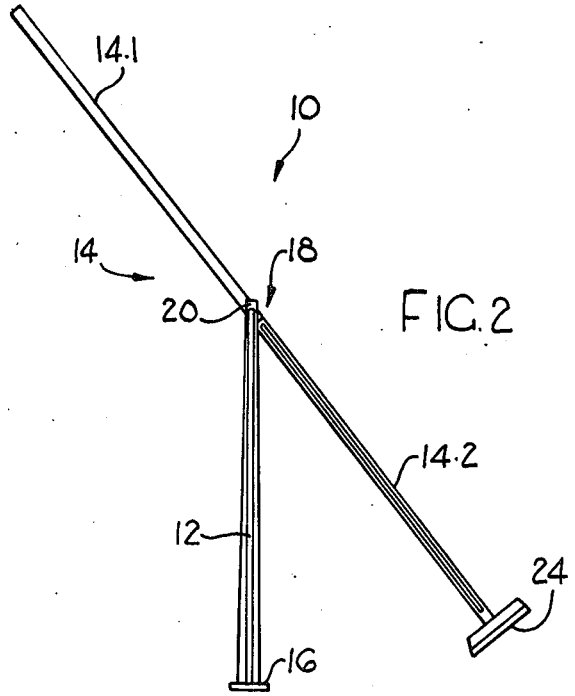
FIG. 2 shows the mast of FIG. 1 in its lowered condition.

As can be seen in FIGS. 1 and 2, the cross sectional dimensions of the mast 10 decrease in an upward direction and, in this embodiment, a light 24 is provided at the upper end of the portion 14.2.

The first and second sections are of hollow constructions and the second section contains electrical wiring (not shown) interconnecting the light 24 to a plug 26 provided in the portion 14.1 of the second section. The plug 26 in the embodiment illustrated fits matingly in a socket 28 provided in the first section 12. The socket 28 would be connected to an electrical mains supply in the normal fashion.

Figure 4:
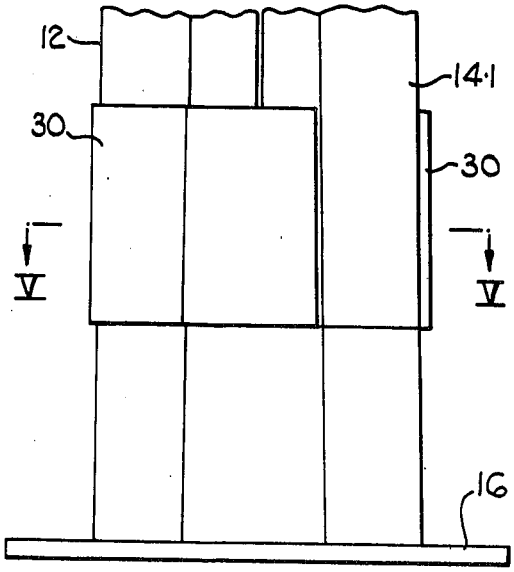
FIG. 4 shows a side elevation to a larger scale of the bottom portion of the mast.

Also as shown in FIGS. 4 to 6, both of the sections 12 and 14 have a guide formation in the form of a plate 30 for guiding the sections during pivotal movement proximate to the operative position of the mast. The plates 30 also assist in supporting the mast while in its operative position.

Instead of the fixed plug and socket arrangement shown in FIGS. 5 and 6, the electrical wiring may terminate in a flexible lead with a loose plug at its end which is removably plugable into a fixed socket. The socket 28 is conveniently located inside a protective housing (not shown) to inhibit water reaching its connections.

Figure 7:
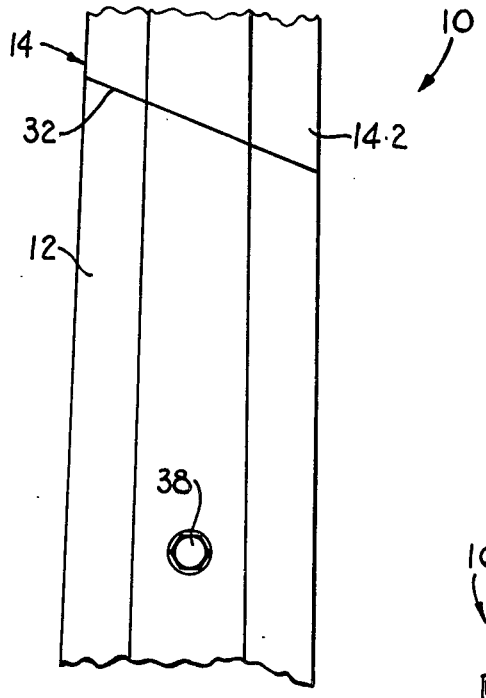
FIGS. 7 and 8 show side elevations of portion of the mast at its pivotal interconnection.
Figure 8:
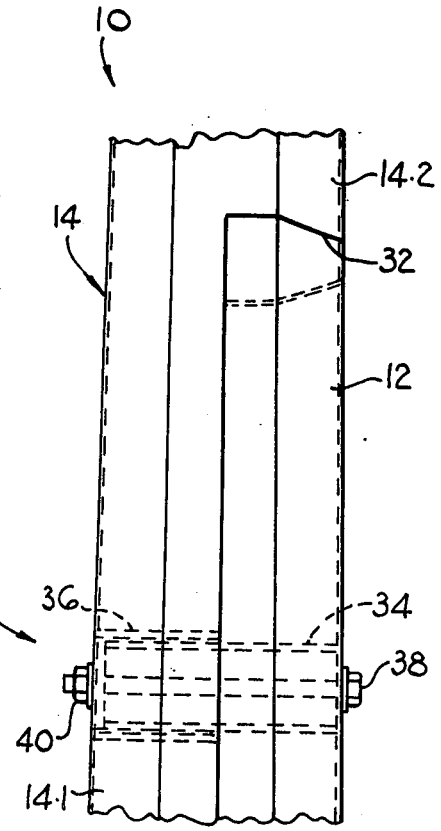

As shown in FIGS. 7 and 8, a slanting face 32 is provided at the end of the first section 12 and which cooperates with a mating slanting face provided on the portion 14.2 of the second section 14. The slanting faces 32 permit pivoting of the second section 14 relative to the first section 12 in one direction only. Opposed faces forming the slanting faces 32 conveniently have frictional engagement members thereon to frictionally retain the mast in its operative position. Typical frictional engagement members are rubber strips or the like. The frictional engagement members also minimize oscillation of the mast under windy conditions.

If desired, further frictional engagement members may be provided at suitable positions on the faces 22.1 and 22.2.

Referring now to FIG. 3, the pivotal interconnection generally indicated at 18 includes a bush 34 extending transversely from an inner wall of the first section 12 and a cylindrical socket 36 extending transversely from an opposed wall of the portion 14.1 of the second section. The bush 34 is received in the socket 36 and the two sections are held together by a bolt 38 which passes through registering holes in the two sections and is fastened by a nut 40.

A layer of material such as neoprene may be located between the outer wall of the bush 34 and the inner wall of the socket 36. A spacer or wearing plate 42 is located between the closed end 44 of the bush 34 and the inner wall of the member 14.1

In use, when it is desired to lower the mast, a chain or rope is attached to the lower portion 14.1 of the second section and pressure is applied to the lower portion 14.1 to cause pivoting of the second section while playing out the rope or chain to ease the travel of the light towards its lowered position. Conveniently, ballast (not shown) is provided in the lower end of the portion 14.1 to balance the mass of the light 24. The light 24 can thus be serviced or repaired with very little effort and without the necessity of a repairman climbing up or being lifted to the light. In order to return the mast to its erected position, the rope or chain is merely pulled. When the second section 14 is returned to its operative position, a locating bolt (not shown) can be fitted through mating apertures provided in the first and second sections to ensure that the first and second sections are retained in their operative positions.

The mast, because of its octagonal cross sectional profile, defines a sturdy arrangement. Because of the sliding contact faces 22.1 and 22.2, the first and second sections are easily supported by a relatively light construction bush 34 and socket 36.

The mast need not be used as a light mast but could also be used in other applications, e.g. as a radio mast or the like. Furthermore, instead of a single light 24, a light cluster may be fitted on the mast. The mast could also, if necessary, be mounted cantilever-fashion rather than in the upright position.

What I claim is:

1. A lowerable mast comprising first and second sections, the first section being anchorable at one end in an anchoring position, the second section being pivotally connected intermediate its ends to the first section by a pivotal interconnection with portion of its one end in overlapping relationship with at least portion of the first section in any of its pivotal positions, the overlapping regions of the first and second sections being each semi-cylindrical providing opposed inwardly directed flat faces which co-operate slidably to support the second section relative to the first section, the remaining portion of the second section remote from its overlapping region having a cross sectional profile corresponding to the combined outer cross sectional profile of the overlapping regions of the first and second sections to provide a mast of substantially constant cross-sectional profile when in its operative erect position, and the pivotal interconnection including a bush fixed to extend transversely from an inner wall of one of the first and second sections, the bush being rotatably received in a cylindrical socket fixed to extend transversely outwardly from an opposed inner wall of the other of the first and second sections, the first and second sections being held together by a transverse pin extending coaxially through the socket and the bush.

2. A mast as claimed in claim 1, in which the overlapping regions of the first and second sections are each of semi-octagonal cross sectional profile.

3. A mast as claimed in claim 1, in which the cross sectional dimensions of the mast decrease in a direction away from the anchoring position.

4. A mast as claimed in claim 1, which includes attachment means at the other end of the second section for attaching a light thereto.

5. A mast as claimed in claim 4, in which the second section is hollow and contains electrical wiring interconnecting the light and a disconnectable terminal provided at or near said one end of the second section.

6. A mast as claimed in claim 5, in which the disconnectable terminal includes a plug adapted to fit matingly in a socket provided in the first section.

7. A mast as claimed in claim 1, in which the first section has a slanting face at its end remote from the anchoring position and the second section has a mating slanting face adapted to co-operate with the slanting face of the first section to permit lowering of the second section in one direction only.

8. A mast as claimed in claim 1, which includes a guide formation on one of the first and second sections for guiding the sections during pivotal movement proximate to the operative position of the mast.

9. A mast as claimed in claim 1, in which the first and second sections have frictional engagement members on opposed faces at suitable positions, adapted to frictionally retain the mast in its operative position.

* * * * *